US006943300B2

(12) United States Patent
Ekeberg et al.

(10) Patent No.: US 6,943,300 B2
(45) Date of Patent: Sep. 13, 2005

(54) FLEXIBLE ELECTRICAL ELONGATED DEVICE SUITABLE FOR SERVICE IN A HIGH MECHANICAL LOAD ENVIRONMENT

(75) Inventors: Knut Ivar Ekeberg, Norge (NO); Torfinn Ottesen, Norge (NO)

(73) Assignee: Nexans, Paris (FR)

( * ) Notice: Subject to any disclaimer, the term of this patent is extended or adjusted under 35 U.S.C. 154(b) by 0 days.

(21) Appl. No.: 10/729,351

(22) Filed: Dec. 4, 2003

(65) Prior Publication Data

US 2005/0034891 A1 Feb. 17, 2005

(30) Foreign Application Priority Data

Aug. 13, 2003 (NO) ..... 033583
Oct. 21, 2003 (NO) ..... 034699

(51) Int. Cl.[7] ..... H01B 7/00
(52) U.S. Cl. ..... 174/113 R; 174/113 C
(58) Field of Search ..... 174/36, 110 R, 174/113 R, 113 C, 115

(56) References Cited

U.S. PATENT DOCUMENTS 1,008,370 A * 11/1911 Robillot ..... 174/113 R
3,603,715 A * 9/1971 Eilhardt et al. ..... 174/15.5
5,177,809 A * 1/1993 Zeidler ..... 385/105
6,222,130 B1 * 4/2001 Gareis et al. ..... 174/113 C
6,239,363 B1 * 5/2001 Wooters ..... 174/47
6,288,340 B1 * 9/2001 Arnould ..... 174/113 R
6,639,152 B2 * 10/2003 Glew et al. ..... 174/113 C
6,748,147 B2 * 6/2004 Quinn et al. ..... 385/110

* cited by examiner

*Primary Examiner*—William H. Mayo, III
(74) *Attorney, Agent, or Firm*—Sofer & Haroun, LLP

(57) ABSTRACT

A flexible electrical elongated device is provided, suitable for service in a high mechanical load environment. The device has a longitudinal axis, and at least one elongated electrical conductor element. The device further has an elongated load bearing component along the longitudinal axis and has an external surface including at least one groove disposed along the longitudinal axis. The groove is designed for holding the conductor element within it while allowing the conductor element to move substantially radially when the device is bent.

20 Claims, 4 Drawing Sheets

FIG_5a
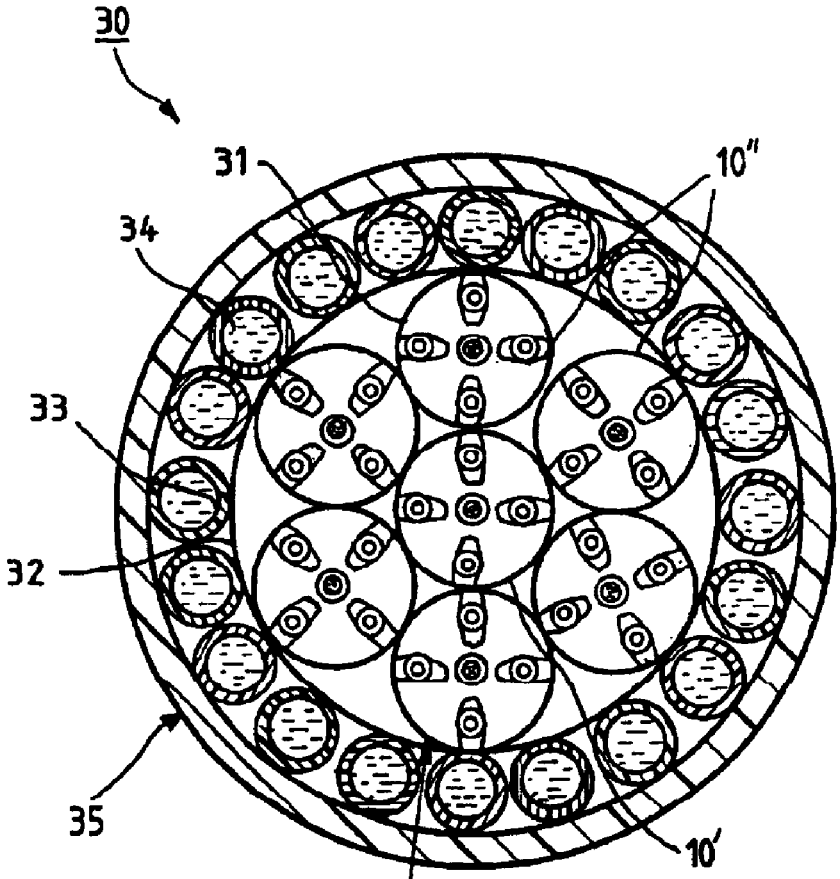
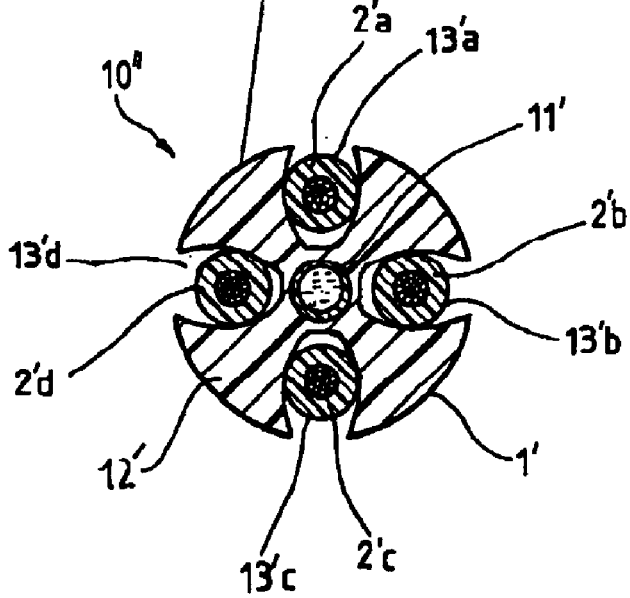
FIG_5b

FLEXIBLE ELECTRICAL ELONGATED DEVICE SUITABLE FOR SERVICE IN A HIGH MECHANICAL LOAD ENVIRONMENT

The present invention relates to flexible elongated electrical device suitable for service in a high mechanical load environment.

FIELD OF THE INVENTION

This application is related to and claims priority from Norwegian Patent Application No. 2003 3583, filed on Aug. 13, 2003, and Norwegian Patent Application No. 2003 4699, filed on Oct. 21, 2003, the entirety of which are incorporated herein by reference.

BACKGROUND OF THE INVENTION

The demand for electrical power supply at the sea floor increases with the increasing water depth at which oil production is being performed. This means that electrical energy must be supplied through power cables. These power cables have to hang freely suspended from the floating production vessel and down to the seabed, i.e. so-called dynamic cables.

Copper is the most common metal used in electrical conductor element. Although having excellent electrical properties such as high conductivity, copper does not have mechanical properties suitable for withstanding the loads imposed during cable installation and during dynamic service, facing the motions induced by wind, currents and waves, and also the high external pressure at the seabed.

Copper has a high density and a low mechanical strength. The high density indirectly leads to large inertia forces during installation and dynamic service.

The low mechanical strength implies that copper will not contribute much to the cable's overall strength or axial stiffness. Furthermore, copper also has a relatively small acceptable maximum strain limit as well as strain range to operate within during dynamic service.

In the existing power cable technology, several conductor elements with a copper core are wound around each other in a bundle surrounded by a number of load bearing armor layers. The load transferring mechanism from each conductor element to the load bearing armor layers is internal friction, which is an unreliable servant.

Moreover, the copper core is classically made of stranded copper wires. Therefore, when a conductor element is subjected to relatively high tensions, contact forces between the copper wires will also be relatively high. Such high contact forces and relative movement between copper wires may cause fretting to occur. And copper has relatively low fretting resistance.

OBJECTS AND SUMMARY OF THE INVENTION

It is an object of the invention to provide a flexible electrical elongated device suitable for service in a high mechanical load environment by way of example, hanging freely from the sea surface and down to the seabed, in ultra deep water oil field.

The invention thus aims at providing a reliable load-transferring feature from one or more conductor elements to a load-bearing element in a power cable, thereby ensuring low strains in the conductor element(s).

More broadly, the invention can also be applied to signal cable elements of umbilical cables.

The invention also aims at ensuring low contact forces in each conductor element having a core made of stranded wires.

The invention is particularly appropriate to conductor element(s) using a material having a high conductance and low mechanical properties such as copper.

To this purpose, the invention provides a flexible electrical elongated device suitable for service in a high mechanical load environment, wherein said device has a longitudinal axis and comprises:

- at least one elongated electrical conductor element,
- an elongated load bearing component along said longitudinal axis and having an external surface comprising at least one groove along said longitudinal axis,
- said groove being designed for holding said conductor element within it while allowing said conductor element to move substantially radially when said device is bent.

The load bearing component of the invention increases the relative axial stiffness of the device, which thereby ensures lower conductor element strains.

The groove holds the conductor element in a way to transfer the mass and inertia forces of this conductor element to the load bearing component.

The conductor element can move radially in the groove i.e. towards and away from the load bearing component, to accommodate the bending.

Of course, the conductor element can be a high, medium, or low voltage conductor and with copper wires stranded together.

Advantageously, the load bearing component comprises:

- an internal element along said longitudinal axis and made of axial stiffness material and,
- a polymeric layer bonded around said internal element, said polymeric layer having said external surface.

The internal element is any device suitable to carry high axial loads and suitable to bond to the polymeric layer. The polymeric layer as well as the polymeric layer/internal element interface is capable of transferring the mass and inertia loads.

The thickness of the polymeric layer is determined by the size of the conductor element(s). Of course, the diameter of the conductor element is lower than the thickness of the polymeric layer.

The internal element can be a rod or a tube suitable for transporting hydraulic fluid, power, lubrication or chemical injection fluids.

The internal element can also be made of a material selected among steel, fiber and composite and preferably is a central element.

The polymeric layer can be made of a crosslinked polyethylene or a thermoplastic polymer and can be preferably an extruded layer.

In a first embodiment, the polymeric layer is so elastic that the conductor can be snug fit in the groove, and said conductor element can able to move substantially radially by deformation of the polymeric layer.

By way of example, the groove has a circular like shape and the polymeric layer is a soft material.

In second embodiment, when said device is straight, the cross-section shape of said groove, in a perpendicular plane to said longitudinal axis, is oval like. And said conductor element fits with elasticity within said groove.

The shape of this groove allows the radial displacement of the conductor element as the device is bent.

In a third embodiment, when said device is straight, the cross-section shape of said groove, in a perpendicular plane to said longitudinal axis, is defined by two sidewalls substantially parallel to each other and a round like shape bottom wall. A soft filler material is inserted between the conductor element and said bottom wall.

The elasticity of the soft filler material allows the radial movement of the conductor element by way of deformation when the device is bent.

The groove can be straight, i.e. in parallel with the longitudinal axis, but, preferably, the groove can have a helical shape to reduce the amplitude of the radial movement.

In peculiar, the helical angle of a helical groove can be comprised between 5 and 85 degrees from said longitudinal axis and preferably between 50 and 80 degrees.

Indeed, the value of the helical angle is determined by the balance between the amount of bending the device will be subjected to, e.g. during installation or dynamic service, and the practical amount of radial sliding the device design can accommodate. The helical angle reduces the amount of friction which is relied upon to transfer the mass and inertia forces to the load bearing component.

The helical angle of the groove(s) can be as large as practicably possible and also depends on the available space e.g. the number of grooves or the conductor type.

Preferably, the device can also comprise a plurality of parallel grooves, each groove including only one conductor element.

According to an additional characteristic of the invention, the groove can be tight enough to hold said conductor element substantially continuously along said longitudinal axis, thereby ensuring optimized continuous transfer of mass and inertia forces in all the length.

According to an additional characteristic of the invention, said device being a power submarine cable, it can comprise an outer protective jacket surrounded said load bearing component and allowing penetration of seawater in said groove. Said jacket is a barrier against foreign objects, and the seawater filled in the groove(s) provides pressure compensation at large water depths.

In an advantageous manner, at predefined interval(s) along said groove, the groove has a maximum width between sidewalls greater than the radial dimension of said conductor element, thereby allowing said seawater to move when said conductor element moves.

The invention also provides an umbilical cable comprising signal cable elements wherein at least one of said signal cable elements is said flexible electrical elongated device as defined previously.

Said flexible electrical elongated device can be disposed in the core of said cable, in a first layer including signal cable elements around the core, and/or in a second layer including signal cable elements around said first layer.

BRIEF DESCRIPTION OF THE DRAWINGS

Further characteristics and advantages of the invention will become clear on reading the following description of embodiments of the invention, given by way of examples only, and made with reference to the accompanying drawings in which:

FIG. 5*a* is a diagrammatic cross sectional view of an umbilical cable which incorporates signal cable elements in a second embodiment of the invention, FIG. 5*b* is a diagrammatic cross sectional view of one of the signal cable elements shown in FIG. 5*a*.

DETAILED DESCRIPTION

Figure 1:
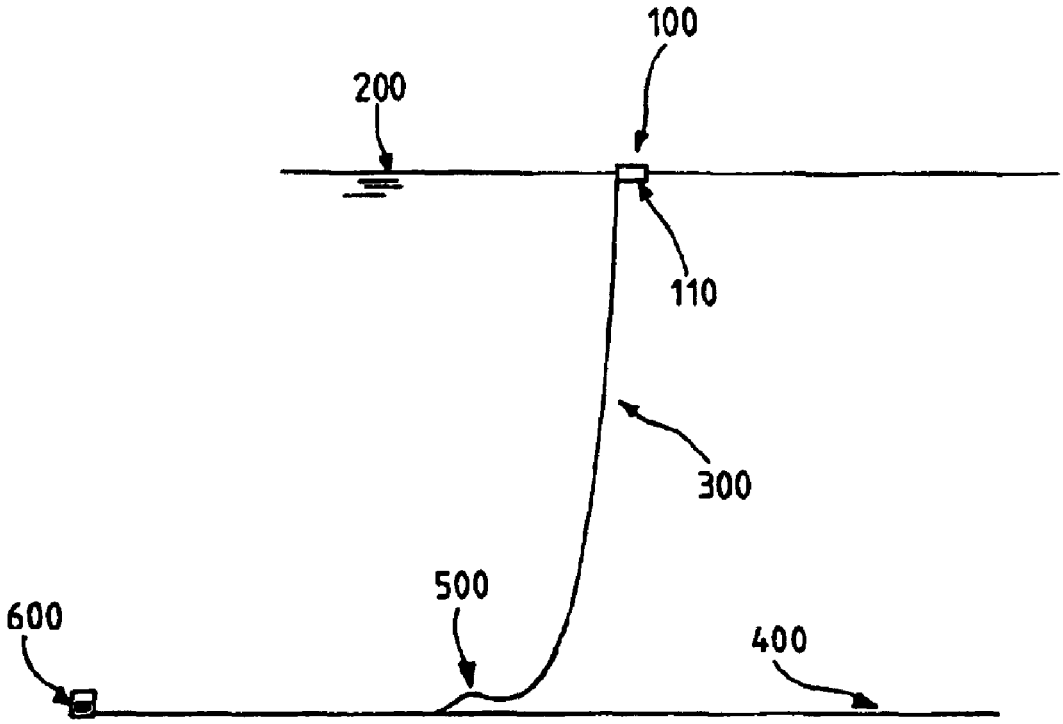
FIG. 1 shows a classical floating production facility and a flexible vertical submarine cable.

FIG. 1 shows a classical floating production facility 100 floating at the sea surface 200 in ultra deep water eg. 3000 m. A flexible vertical submarine cable 300 (e.g. a dynamic power cable or dynamic umbilical cable) is hanging towards the seabed 400 in a lazy wave configuration.

A lazy wave configuration implies that buoyancy 500 is introduced primarily to dampen out system dynamics. At the platform end, the cable 300 is connected to a power supply 100, and at the seabed 400, the cable 300 is connected to the appropriate subsea equipment, whether it is a subsea pump 600, a pipeline (for pipeline resistive heating) or any other subsea based or power consuming equipment.

Figure 2A:
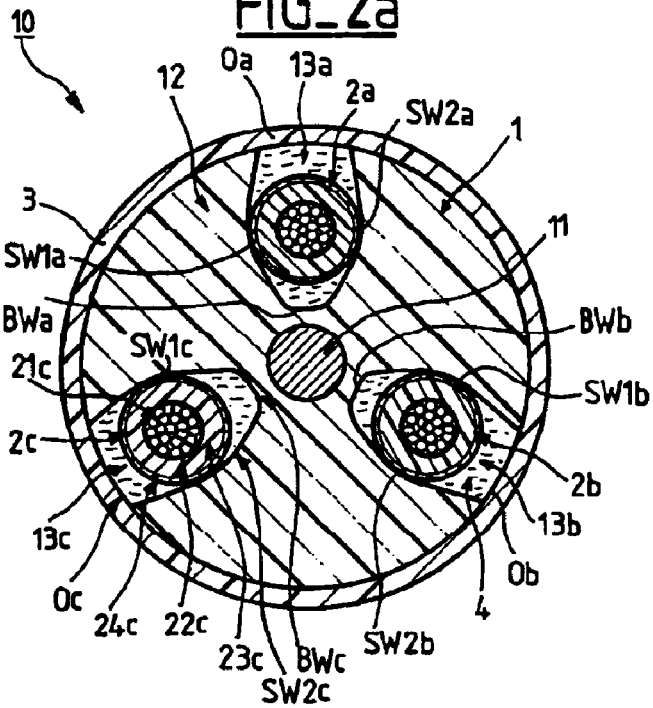
FIGS. 2*a* and 2*b* are respectively a schematic cross sectional view and a partial schematic longitudinal view of a flexible vertical submarine power cable in a straight condition in a first embodiment of the invention.

FIG. 2*a* is a schematic cross sectional view of a vertical power submarine cable (not to scale) 10 in a straight condition, in a first embodiment of the invention.

Such a cable 10 delivers power to a subsea system and is hanging freely suspended from a floating production vessel and down to the seabed. By way of example, such a cable 10 can replace the classical cable 300 shown in FIG. 1.

Starting from the center and moving radially to the periphery, around a longitudinal axis X, the power cable 10 comprises:

- an elongated load bearing component 1 including:
  - an internal element 11 which is a rod suitable to carry high axial loads made of a axial stiffness material such as steel,
  - and an polymeric layer 12 made of extruded crosslinked polyethylene and bonded around the rod 11, such a layer 12 including three helical grooves 13*a–c* on its external surface,
- three power conductor elements 2*a–c* intended to transport electrical energy, placed within one distinct groove 13*a–c* respectively.

These conductors 2*a–c* include preferably large copper conductor core made of stranded copper wires 21*c* encompassed by a plurality of sheaths (not completely referenced for a better clarity of the figure) including by way of example a conductor screen 22*c* in semiconducting crosslinked polyethylene (XLPE), surrounded by an insulation sheath 23*c* of a conductor element XLPE and by an additional sheath of semiconducting polyethylene 24*c*.

One (or more) outer cover 3 allowing penetration of sea water 4 is provided, each groove 13*a–c* being allowed to be flooded with seawater 4 to provide pressure compensation at large water depths.

The helical grooves 13*a–c* extend all along the power cable 10 and preferably are equally spaced from each other.

The cross-section shape of each groove 13*a–c* is oval like, without taking into consideration the opening Oa–c, thus with a round like bottom wall BWa–c and two curved (concave) sidewalls SW1*a–c*, SW2*a–c*.

Before the insertion of the conductors elements 2*a–c*, the maximum width between sidewalls SW1*a–c*, SW2*a–c* is slightly lower (or equal) to the diameter of the conductor elements 2*a–c*. Therefore each inserted conductor elements tend to stay in a centralized position in the respective groove when the power cable 10 is in the straight condition.

Furthermore, each groove 13*a–c* allows one conductor element 2*a–c* inside to move substantially radially when the power cable 10 is bending.

Figure 2B:
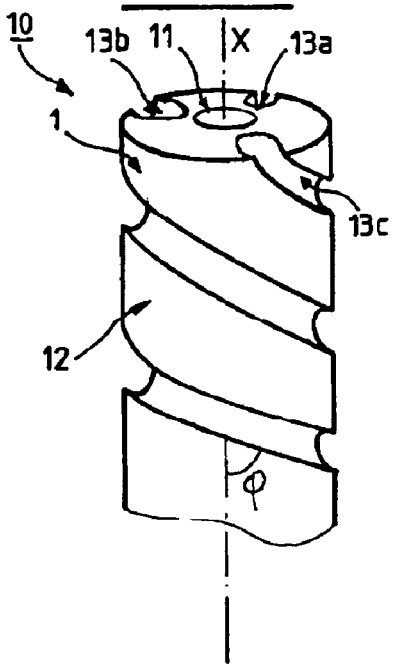

As shown in a longitudinal view of FIG. 2*b*, the helical angle T of each groove 13*a–c* is around 70 degrees from the longitudinal axis X.

In this groove design, these conductor elements 2*a–c* are held quasi continuously in their whole length. At a fixed interval along the groove, each groove 13*a–c* is made wider than the received conductor element 2*a–c* to allow water to move as the conductor moves (not shown).

Each conductor element 2*a–c* is disposed on purpose in a middle position from the bottom walls BWa–c of the grooves 13*a–c* and the opening Oa–c, forced to this position during installation.

Figure 3A:
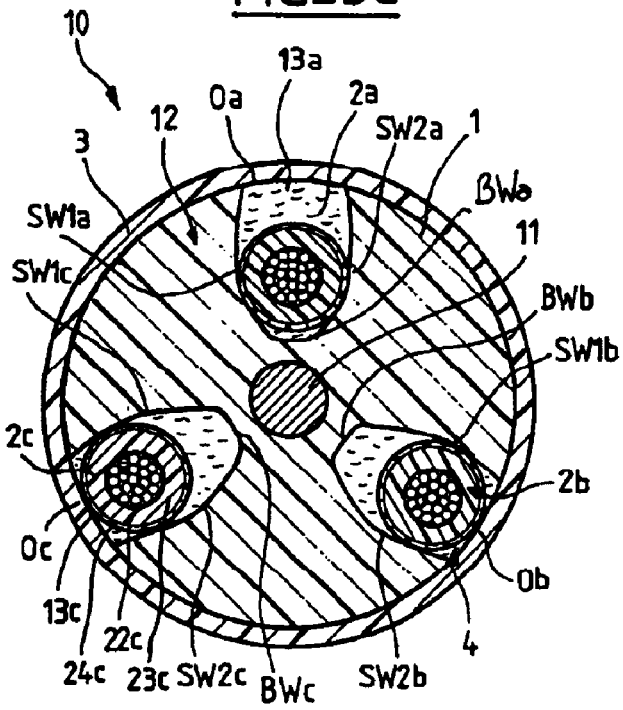
FIGS. 3*a* and 3*b* are respectively a schematic cross sectional view and a partial schematic longitudinal view of the flexible vertical submarine power cable in a bent condition.
Figure 3B:
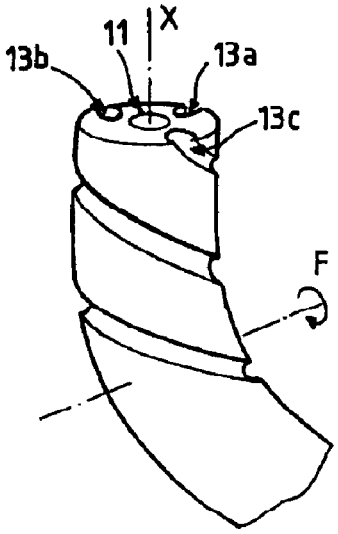

FIGS. 3*a–b* illustrate how the conductor elements 2*a–c* move when the cable 10 is bent.

The cable 10 shown in FIG. 3*a* is bent towards a given direction F. The upper conductor element 2*a* slides radially towards the axis X of the power cable 10 while the other conductor elements 2*b–c* slide radially away from the axis X.

When the bending is reversed, and the power cable 10 is brought back to the straight condition, the conductor elements 2*a–c* slide in the opposite direction therefore returning to the middle way position.

Figure 4A:
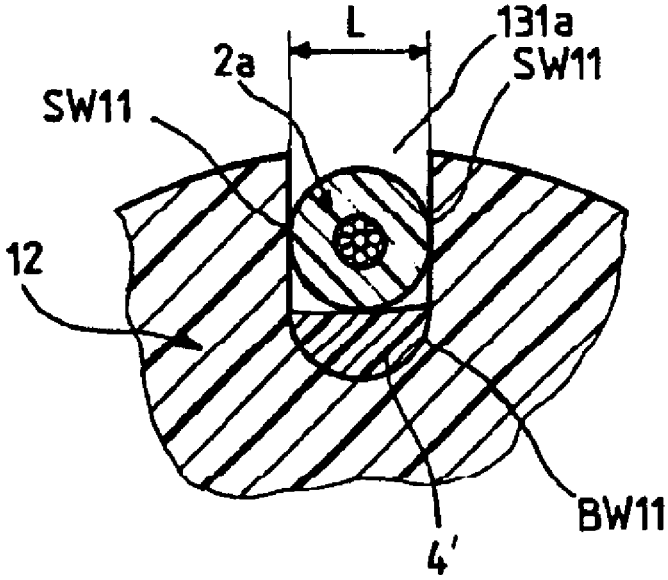
FIGS. 4*a* and 4*b* are a schematic cross sectional view of a groove in two alternatives of the first embodiment.

FIG. 4*a* and *b* is a diagrammatic cross-sectional view of two other ways a groove can be made to accommodate the radial displacement a conductor element 2*a–c* experiences as the power cable 10 is bent, in alternatives of the first embodiment.

In FIG. 4*a* the cross-section shape of the groove 131*a* is defined by two parallel sidewalls SW11 and a round like shape bottom wall BW11.

A soft filler material 4' is inserted between the conductor element 2*a* and the bottom wall BW11. The groove 13 is also preferably filled with seawater 4.

The distance L between the sidewalls SW11 is slightly lower the initial diameter of the conductor element 2*a* inside.

In this groove design, each conductor element 2*a–b* is held continuously in the whole length and additionally is disposed on purpose in a middle way position from the bottom wall BW11 of the grooves and the openings O of the grooves 131*a*. Furthermore, the groove 131*a* and the soft filler 4' allow the conductor element 2*a* inside to move substantially radially when the power cable is bent.

When the bending is reversed and the power cable brought back to a straight condition, the cable elements 2*a–c* slide in the opposite direction returning to the middle way position.

Figure 4B:
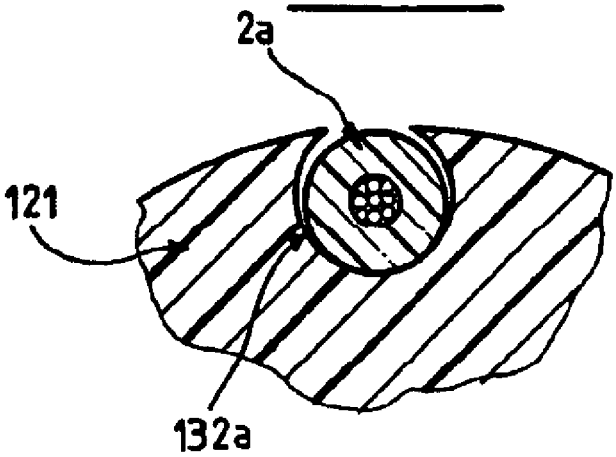

In FIG. 4*b*, the polymeric layer 121 is made of a sufficiently soft material so that deformation of the polymeric layer accommodates the conductor's radial displacement. When the device is in a straight position, the groove 132*a* has a quasi circular shape (in cross section view) and the conductor element 2*a* is snug fit inside.

FIG. 5*a* is a diagrammatic cross sectional view of an umbilical cable 30 which incorporates signal cable elements in a second embodiment of the invention.

This dynamic umbilical cable 30 is hanging freely suspended from a floating production vessel and down to the seabed similar to what is illustrated in FIG. 1.

Starting from the center of the umbilical 30 and moving radially till the periphery, the umbilical cable 30 comprises:

a central signal cable element 10' forming a core, a first layer 31 of six other signal cable elements 10" around said central element 10', a protective wrapping 32, a second layer 33 of steel tubes 34, and outer covers 35 allowing entrance of sea water.

As shown in FIG. 5*b*, starting from the center and moving radially till the periphery, the signal cable element 10" comprises:

a load bearing component 1' comprising:

an internal element 11' which is a steel tube containing hydraulic fluid delivered to a subsea control system, and a polymeric layer 12' made of thermoplastic polymer and bonded around the tube 11' and such a layer 12' preferably extruded, including four helical grooves 13'*a–d* on its external surface, and four conductor elements 2'*a–d* intended to transport control signals, placed within the grooves 13'*a–d*.

The helical grooves 13'*a–d* extend all along the polymeric layer 12' and preferably are equally spaced from each other.

The helical angle of the grooves 13'*a–d* is some 5 to 85 degrees with the longitudinal axis, depending on the available space.

The cross-section shape of the grooves 13'*a–d* is similar to the one shown in the FIGS. 2 and 3. Each groove 13'*a–d* allows the conductor element 2'*a–d* inside to move substantially radially when the signal cable element 10' or 10" is bent.

When the bending of the umbilical 30 is reversed and the signal cable element 10' or 10" brought back to a straight condition, the conductor elements 2'*a–d* slide in the opposite direction returning to the middle way position.

Those signal cable elements 10', 10" therefore will not break when used in the umbilical 30 installed in ultra deep water. The load bearing 1' increases the relative axial stiffness of the signal cable element, which thereby ensures lower conductor element signal cable element strains.

The grooves 13'*a–d* hold the conductor elements 2'*a–d* in a way to transfer the mass and inertia forces of those conductor elements 2'*a–d* to the load bearing component 1'. The polymeric layer 12' as well as the polymeric layer/internal element interface is capable of transferring the mass and inertia loads.

The invention can also be applied in signal cable elements in alternance with the steel tube 34 and/or replacing said steel tubes 34

Alternatively, the central element 10' could be a steel rod.

Alternatively, any of the signal cable elements 10", 10' could be a tube. By way of example, more than half of the elements 10" are tubes and only two elements are signal elements.

Alternatively, the internal element 11' is a steel rod.

What is claimed is:

1. A flexible electrical elongated device, having a longitudinal axis (X) and suitable for service in a high mechanical load environment, said device comprising:

at least one elongated electrical conductor element, an elongated load bearing component along said longitudinal axis and having an external surface including at least one groove disposed along said longitudinal axis, said groove configured to hold said conductor element within it and against the inside surface of said groove continuously along substantially the entire length of said device, while allowing said conductor element to move substantially radially when said device is bent.

2. A flexible electrical elongated device according to claim 1 wherein said load bearing component comprises:

an internal element along said longitudinal axis (X) and made of axial stiffness material and a polymeric layer bonded around said internal element, said polymeric layer having said external surface.

3. A flexible electrical elongated device according to claim 2 wherein, said internal element is a rod or a tube suitable for transporting hydraulic fluid, power, lubrication or chemical injection fluids.

4. A flexible electrical elongated device according to claim 2 wherein said internal element is made of a material selected among steel, fiber and composite.

5. The flexible electrical elongated device according to claim 4, wherein said internal element is a central element.

6. A flexible electrical elongated device according to claim 2 wherein said polymeric layer is made of a crosslinked polyethylene or a thermoplastic polymer.

7. The flexible electrical elongated device according to claim 6, wherein said polymeric layer is an extruded layer.

8. A flexible electrical elongated device according to claim 2 wherein said polymeric layer is so elastic that said conductor element is snug fit in said groove, and wherein said conductor element is able to move substantially radially by deformation of said polymeric layer.

9. A flexible electrical elongated device according to claim 1 wherein, when said device is straight, the cross-section shape of said groove, in a perpendicular plane to said longitudinal axis (X), is oval like, and wherein said conductor element fits with elasticity within said groove.

10. A flexible electrical elongated device according to claim 1 wherein, when said device is straight, the cross-section shape of said groove, in a perpendicular plane to said longitudinal axis, is defined by two sidewalls substantially parallel to each other and a round like shape bottom wall, and wherein a soft filler material is inserted between said conductor element and said bottom wall.

11. A flexible electrical elongated device according to claim 1 wherein said groove has a helical shape.

12. A flexible electrical elongated device according to claim 11 wherein the helical angle (θ) of said helical groove is comprised between 5 and 85 degrees from the longitudinal axis.

13. The flexible electrical elongated device according to claim 12, wherein the helical angle (θ) is between 50 and 80 degrees.

14. A flexible electrical elongated device according to claim 1 wherein it comprises a plurality of parallel grooves, each one including only one conductor element.

15. A flexible electrical elongated device according to claim 1 wherein said groove is tight enough to hold said conductor element substantially continuously along said longitudinal axis (X).

16. A flexible electrical elongated device according to claim 1 wherein, said device, being a power submarine cable, it comprises an outer protective jacket surrounding said load bearing component and allowing penetration of seawater in said groove.

17. A flexible electrical elongated device according to claim 16 wherein, at predefined intervals along said groove, said groove has a maximum width between sidewalls greater than the radial dimension of said conductor element.

18. An umbilical cable, said cable comprises:

signal cable elements wherein at least one of said signal cable elements is said flexible electrical elongated device according to claims 1.

19. The umbilical cable according to claim 18 wherein said flexible electrical elongated device is disposed in the core of said cable.

20. The umbilical cable according to claim 18 wherein said flexible electrical elongated device is disposed in a first layer including signal cable elements around a core and/or in a second layer including signal cable elements around said first layer.

* * * * *